US011557423B2

(12) United States Patent
Inaba

(10) Patent No.: US 11,557,423 B2
(45) Date of Patent: Jan. 17, 2023

(54) COIL AND REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventor: Kazuhiro Inaba, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 518 days.

(21) Appl. No.: 16/487,522

(22) PCT Filed: Feb. 6, 2018

(86) PCT No.: PCT/JP2018/004055
§ 371 (c)(1),
(2) Date: Aug. 21, 2019

(87) PCT Pub. No.: WO2018/155172
PCT Pub. Date: Aug. 30, 2018

(65) Prior Publication Data

US 2020/0058437 A1 Feb. 20, 2020

(30) Foreign Application Priority Data

Feb. 22, 2017 (JP) ..... JP2017-031433

(51) Int. Cl.
*H01F 27/28* (2006.01)
*H01F 27/24* (2006.01)

(52) U.S. Cl.
CPC ..... *H01F 27/2823* (2013.01); *H01F 27/24* (2013.01)

(58) Field of Classification Search
CPC .. H01F 27/2823; H01F 27/24; H01F 27/2847; H01F 37/00
See application file for complete search history.

(56) References Cited

U.S. PATENT DOCUMENTS 3,538,473 A * 11/1970 Leibinger ..... H01F 27/2871 336/187
5,726,618 A * 3/1998 Romer ..... H01F 29/146 336/175

(Continued)

FOREIGN PATENT DOCUMENTS

JP S49-022352 Y1 6/1974
JP 2000-195725 A 7/2000

(Continued)

OTHER PUBLICATIONS

International Search Report, Application No. PCT/JP2018/004055, dated Apr. 24, 2018. ISA/Japan Patent Office.

*Primary Examiner* — Mang Tin Bik Lian
(74) *Attorney, Agent, or Firm* — Honigman LLP

(57) ABSTRACT

A coil includes a first winding portion having a first wire helically wound including at least one strand, and a second winding portion having a second wire helically wound including a plurality of strands electrically connected to the first winding portion and has an axis that is parallel to an axial direction of the first winding portion, wherein the strands included in the second wire are arranged in parallel in an axial direction of the second winding portion, the number of strands included in the second wire is greater than the number of strands included in the first wire, the cross-sectional area of the second wire is equal to or larger than the cross-sectional area of the first wire, and the cross-sectional area of each strand included in the second wire is equal to or smaller than the cross-sectional area of each strand included in the first wire.

5 Claims, 2 Drawing Sheets

(56) References Cited

U.S. PATENT DOCUMENTS

| | | | | |
|---|---|---|---|---|
| 2003/0174039 | A1* | 9/2003 | Bodger | H01F 27/245 336/223 |
| 2010/0156194 | A1* | 6/2010 | Navid | H02M 1/126 307/105 |
| 2013/0099887 | A1* | 4/2013 | Yamamoto | H01F 27/2804 336/220 |
| 2013/0242452 | A1* | 9/2013 | Park | H01F 27/40 361/143 |
| 2015/0352965 | A1 | 12/2015 | Inaba et al. | |

FOREIGN PATENT DOCUMENTS

| | | | |
|---|---|---|---|
| JP | 2009-267074 | A | 11/2009 |
| JP | 2015-090912 | A | 5/2015 |
| JP | 2016-015366 | A | 1/2016 |
| JP | 2018-049957 | A | 3/2018 |
| WO | 2012-017616 | A1 | 2/2012 |

* cited by examiner

COIL AND REACTOR

CROSS-REFERENCE TO RELATED APPLICATIONS

This application is the U.S. national stage of PCT/JP2018/004055 filed on Feb. 6, 2018, which claims priority of Japanese Patent Application No. 2017-031433 filed on Feb. 22, 2017, the contents of which are incorporated herein.

TECHNICAL FIELD

The present disclosure relates to a coil and a reactor.

BACKGROUND

A reactor disclosed in JP 2014-146656A is known as a component of a circuit that increases and decreases the voltage. This reactor includes a coil having a pair of coil elements (winding portions) and a ring-shaped magnetic core that is combined with the coil. The coil elements are wound the same number of turns and arranged side-by-side in parallel so that their axial directions are parallel to each other (0020 of the specification and FIG. 1).

Depending on the installation state of a reactor, there is a risk that the cooling characteristics will be unbalanced between the two winding portions, and there is room for further improvement in heat generation characteristics of the pair of winding portions.

Thus, an object of the present disclosure is to provide a coil in which a pair of winding portions satisfies a specific relationship with respect to heat generation characteristics.

Another object of the present disclosure is to provide a reactor equipped with the above-described coil.

SUMMARY

A coil according to the present disclosure includes a first winding portion that is formed by helically winding a first wire including at least one strand. A second winding portion is formed by helically winding a second wire including a plurality of strands and being electrically connected to the first winding portion and has an axis that is parallel to an axial direction of the first winding portion.

The strands included in the second wire are arranged in parallel in an axial direction of the second winding portion, the number of strands included in the second wire is greater than the number of strands included in the first wire. A cross-sectional area of the second wire is equal to or larger than a cross-sectional area of the first wire, and a cross-sectional area of each strand included in the second wire is equal to or smaller than a cross-sectional area of each strand included in the first wire.

A reactor according to the present disclosure is a reactor including: a coil; and a magnetic core on which the coil is disposed, wherein the coil is the above-described coil according to the present disclosure.

Advantageous Effects of the Present Disclosure

In the coil of the present disclosure, the pair of winding portions satisfies a specific relationship with respect to heat generation characteristics.

The reactor of the present disclosure is low-loss.

DETAILED DESCRIPTION OF PREFERRED EMBODIMENTS

Figure 1:
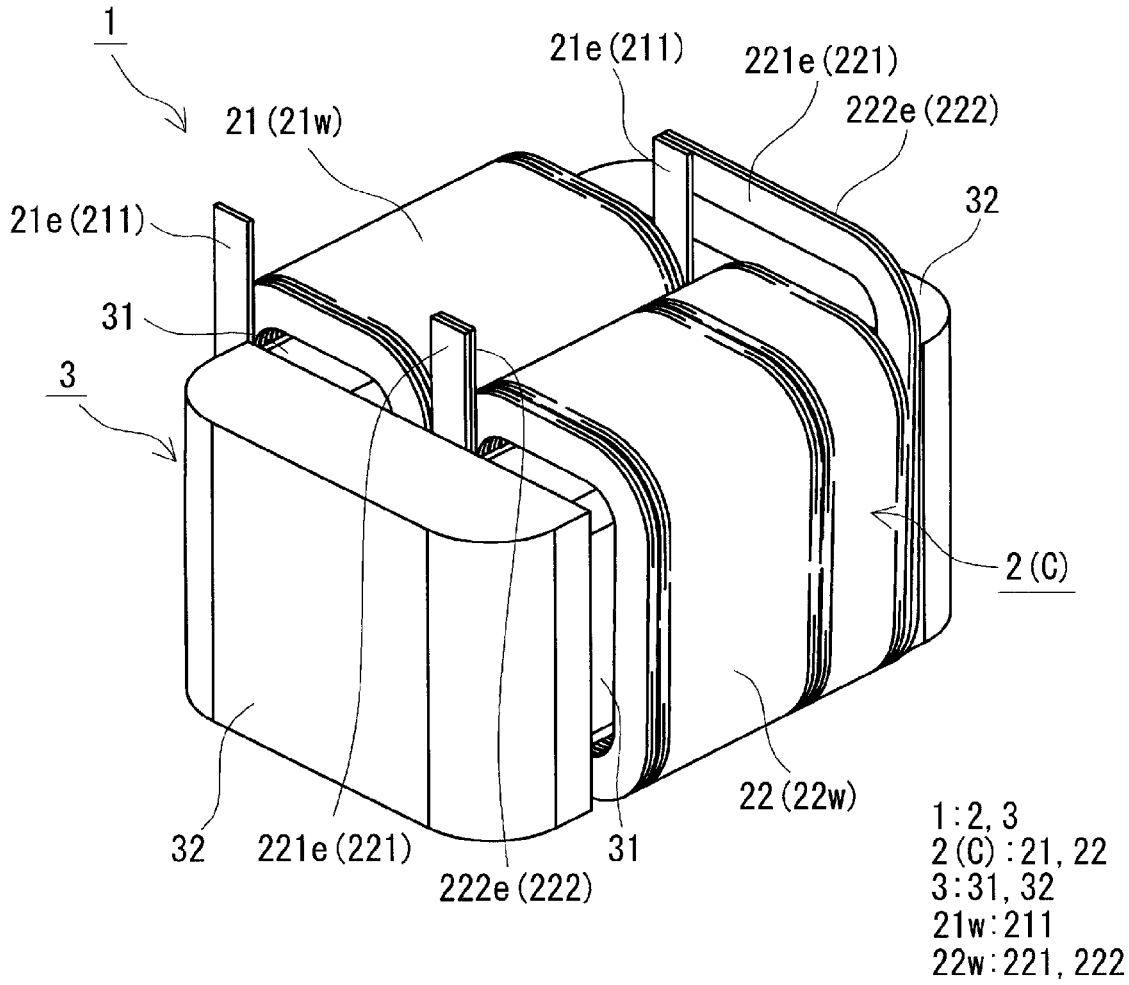
FIG. 1 is an overall perspective view schematically showing a reactor according to Embodiment 1.

Since wires of a pair of winding portions included in a conventional coil have the same cross-sectional area and are wound the same number of turns, when a cooling member has substantially balanced cooling performance, the winding portions are uniformly cooled. The cooling member may be an object on which the reactor is installed, such as a cooling base; a fluid coolant (e.g., ATF:

automatic transmission fluid) that is circulated and supplied; or the like. However, if the cooling member has unbalanced cooling characteristics due to restrictions related to the installation state of the reactor, and the like, one of the winding portions is less well cooled than the other winding portion. In that case, the temperature of one of the winding portions will become higher than that of the other winding portion, leading to an increase in the loss of the reactor.

The inventor of the present disclosure considered that in order to evenly cool a pair of winding portions in the case where the winding portions are cooled by a cooling member with unbalanced cooling performance, it may be sufficient that a specific relationship with respect to heat generation characteristics in which one of the winding portions generates less heat than the other winding portion is satisfied, and conducted in-depth research on making the two winding portions have different heat generation characteristics. As a result, it was found that the two winding portions can be made to have different heat generation characteristics by forming the winding portions using different numbers of strands and also satisfying a specific relationship between the cross-sectional area of a wire of one of the winding portions and the cross-sectional area of a wire of the other winding portion. In that case, the pair of winding portions can be evenly cooled by disposing one of the winding portions, which has the higher heat generation characteristics, on the higher cooling performance side and the other winding portion, which has the lower heat generation characteristics, on the lower cooling performance side. The present disclosure was achieved based on these findings. Embodiments of the present disclosure will be listed and described first below.

A coil according to an embodiment of the present disclosure includes a first winding portion that is formed by helically winding a first wire including at least one strand. A second winding portion is formed by helically winding a second wire including a plurality of strands and being electrically connected to the first winding portion and has an axis that is parallel to an axial direction of the first winding portion. The strands included in the second wire are arranged in parallel in an axial direction of the second winding portion, the number of strands included in the second wire is greater than the number of strands included in the first wire. The cross-sectional area of the second wire is equal to or larger than the cross-sectional area of the first wire, and the cross-sectional area of each strand included in the second wire is equal to or smaller than the cross-sectional area of each strand included in the first wire.

With this configuration, when the first winding portion and the second winding portion are compared with each other in terms of their heat generation characteristics, a specific relationship with respect to heat generation characteristics in which the first winding portion generates more heat and the second winding portion generates less heat is satisfied. The reason for this is that, in the second winding portion, at least one of the DC resistance and the AC resistance is easily reduced, compared with the first winding portion, and therefore, heat generation caused by these resistances can be suppressed.

Specifically, in the case where the cross-sectional area of the first wire and the cross-sectional area of the second wire are equal to each other, the DC resistance of the second winding portion is equal to the DC resistance of the first winding portion, but the AC resistance of the second winding portion is likely to be lower than the AC resistance of the first winding portion. The reason for this is that the cross-sectional area of each strand included in the second wire is smaller than the cross-sectional area of each strand included in the first wire, and thus, an increase in the AC resistance caused by the skin effect can be suppressed. On the other hand, in the case where the cross-sectional area of each strand included in the first wire and the cross-sectional area of each strand included in the second wire are equal to each other, the AC resistance of the second winding portion is equal to the AC resistance of the first winding portion, but the DC resistance of the second winding portion is likely to be lower than the DC resistance of the first winding portion. The reason for this is that the cross-sectional area of the second wire is larger than the cross-sectional area of the first wire. That is to say, in the case where the cross-sectional area of the second wire is larger than the cross-sectional area of the first wire, and the cross-sectional area of each strand included in the second wire is smaller than the cross-sectional area of each strand included in the first wire, the DC resistance and the AC resistance of the second winding portion are likely to be lower than the DC resistance and the AC resistance, respectively, of the first winding portion. A reduction in the AC resistance of the second winding portion is especially effective when the coil is used at a high frequency.

With this configuration, since the aforementioned specific relationship with respect to heat generation characteristics is satisfied as described above, the coil can be suitably used for a reactor that is cooled by a cooling member with unbalanced cooling performance. The reason for this is that when the first winding portion is disposed on the higher cooling performance side of the cooling member and the second winding portion is disposed on the lower cooling performance side of the cooling member, the first winding portion and the second winding portion can be evenly cooled, and the maximum temperature of the coil can be reduced. In particular, the coil can be suitably used for a reactor that is used at a high frequency and cooled by a cooling member with unbalanced cooling performance. Since the maximum temperature of the coil can be reduced as described above, a low-loss reactor can be constructed.

As an embodiment of the above-described coil, it is possible that the difference between the length of the first winding portion in the axial direction and the length of the second winding portion in the axial direction is 10% or less of the length of the first winding portion in the axial direction.

With this configuration, since the difference between the lengths of the first winding portion and the second winding portion in their axial directions is small, if the lengths of the first winding portion and the second winding portion in their axial directions are made substantially the same as the lengths of a pair of inner core portions on which the first winding portion and the second winding portion are respectively disposed, of a magnetic core, a reactor with little dead space is easily constructed.

As an embodiment of the above-described coil, it is possible that conductor wires of the strands included in the first wire and the second wire are rectangular wires, and each strand included in the first wire and each strand included in the second wire have the same width.

With this configuration, since the conductor wires of the strands included in the two wires are rectangular wires, and the strands included in the two wires have the same width, when this coil is combined with a pair of inner core portions, a reactor with little variation in width and height between the first winding portion and the second winding portion can be constructed.

A reactor according to an embodiment of the present disclosure is a reactor including: a coil; and a magnetic core on which the coil is disposed, wherein the coil is the coil according to any one of the above-described embodiments.

With this configuration, the loss can be reduced. The reason for this is that since the reactor includes the coil having the second winding portion that generates less heat and the first winding portion that generates more heat, even when the cooling performance of the cooling member for cooling the coil is unbalanced, the first winding portion and the second winding portion can be uniformly cooled by disposing the second winding portion on the lower cooling performance side and disposing the first winding portion on the higher cooling performance side, and the maximum temperature of the coil can be reduced. Moreover, since the maximum temperature of the coil can be reduced, the material of a peripheral member of the coil can be selected from a wider range of materials.

Hereinafter, details of an embodiment of the present disclosure will be described with reference to the drawings. In the drawings, like reference numerals denote objects having like names. In the following embodiment, a coil and a reactor will be described in that order.

Embodiment 1

Coil

A coil C according to Embodiment 1 will be described with reference to FIGS. 1 and 2. The coil C includes a pair of first and second winding portions 21 and 22. The coil C constitutes a coil 2 that is typically disposed on an outer periphery of a magnetic core 3 (inner core portions 31) included in a reactor 1, which will be described later (FIG. 1). One of the features of the coil C is that wires 21*w* and 22*w* of the respective winding portions 21 and 22 include different numbers of strands, and each strand included in the first wire 21*w* of the first winding portion 21 and each strand included in the second wire 22*w* of the second winding portion 22 satisfy a specific relationship with respect to cross-sectional area. Here, assuming that the reactor 1 is constructed by attaching the coil 2 to the magnetic core 3 and the reactor 1 is installed on an object, such as a cooling base for cooling the coil 2, the object side will be described as the lower side, and the side opposite to the object as the upper side.

First Winding Portion•Second Winding Portion

The first winding portion 21 is a hollow tubular body formed by helically winding the first wire 21*w* including at least one strand 211. The first wire 21*w* may include one or more than one strand 211 as long as the relationship "number of strands included in first wire 21*w*<number of strands included in second wire 22*w*" is satisfied. In the case where the first wire 21*w* includes more than one strand, the first wire 21*w* is helically wound such that the strands are arranged in parallel in the axial direction of the first winding portion 21. Here, the first wire 21*w* is formed of a single strand 211. On the other hand, the second winding portion 22 is a hollow tubular body formed by helically winding the second wire 22*w* including a plurality of strands 221 and 222. The second wire 22*w* includes the two strands 221 and 222 here, but may also include three or more strands. The strands 221 and 222 of the second wire 22*w* are arranged in parallel in the axial direction of the second winding portion 22. That is to say, the strands 221 and 222 are alternately arranged in the axial direction of the second winding portion 22. Here, the second wire 22*w* is formed of two strands 221 and 222.

The first winding portion 21 and the second winding portion 22 are electrically connected to each other in series. Conductors of the respective strands 221 and 222 of the second wire 22*w* are insulated from each other, except in end portions 221*e* and 222*e*, which will be described later, on one end side and the other end side thereof. The two winding portions 21 and 22 are arranged side-by-side (in parallel) so that their axial directions are parallel to each other. The shape of end surfaces of the winding portions 21 and 22 can be appropriately selected, and the end surfaces here are rectangular frame-shaped with rounded corners. Coated wires each including a conductor wire and an insulating coating made of an enamel (typically, polyamideimide) or the like and disposed on an outer periphery of the conductor wire can be used as the strands 211, 221, and 222 of the wires 21*w* and 22*w*. The conductor wire may be a rectangular wire or a round wire made of a conductive material, such as copper, aluminum, or an alloy thereof. Here, coated rectangular wires are used as the strands 211, 221, and 222 of the wires 21*w* and 22*w*, and the winding portions 21 and 22 are edgewise coils formed by winding the coated rectangular wires edgewise.

Cross-Sectional Area

The cross-sectional areas of the first wire 21*w* and the second wire 22*w* satisfy relationships "(cross-sectional area of first wire 21*w*)≤(cross-sectional area of second wire 22*w*)" and "(cross-sectional area of strand 211 of first wire 21*w*)≥(cross-sectional area of strands 221 and 222 of second wire 22*w*)". In the case where the first wire 21*w* includes one strand 211, the cross-sectional area of the first wire 21*w* refers to the cross-sectional area of the single strand 211, and in the case where the first wire 21*w* includes more than one strand 211, the cross-sectional area of the first wire 21*w* refers to the total cross-sectional area of the plurality of strands 211. The cross-sectional area of the second wire 22*w* refers to the total cross-sectional area of a plurality of strands 221 and 222. In the case where the first wire 21*w* includes one strand 211, the cross-sectional area of the strand 211 of the first wire 21*w* refers to the cross-sectional area of the single strand 211, and in the case where the first wire 21*w* includes more than one strand 211, the cross-sectional area of the strand 211 of the first wire 21*w* refers to the cross-sectional area of each strand. In the case where the first wire 21*w* includes more than one strand 211, the strands may have different cross-sectional areas, but preferably have the same cross-sectional area. The cross-sectional area of the strands 221 and 222 of the second wire 22*w* refers to the cross-sectional area of each of the strands 221 and 222. The strands 221 and 222 of the second wire 22*w* may have different cross-sectional areas, but preferably have the same cross-sectional area. If the first wire 21*w* includes strands that have different cross-sectional areas and the second wire 22*w* includes strands that have different cross-sectional areas, "(cross-sectional area of strands of first wire 21*w*)≥(cross-sectional area of strands 221 and 222 of second wire 22*w*)" means "(the smallest cross-sectional area of strands of first wire 21*w*)≥(the largest cross-sectional area of strands of second wire 22*w*)".

The coil C satisfies this relationship, and thus, when the first winding portion 21 and the second winding portion 22 are compared with each other in terms of their heat generation characteristics, a specific relationship with respect to heat generation characteristics in which the first winding portion 21 generates more heat and the second winding portion 22 generates less heat is satisfied. The reason for this is that, in the second winding portion 22, at least one of DC resistance and the AC resistance is easily reduced, compared with the first winding portion 21, and therefore, heat generation caused by these resistances can be suppressed. Accordingly, based on the comparison between the first winding portion 21 and the second winding portion 22 in terms of their heat generation characteristics, the first winding portion 21, which generates more heat, is disposed on the higher cooling performance side of a cooling member (here, a cooling base), and the second winding portion 22, which generates less heat, is disposed on the lower cooling performance side of the cooling member (cooling base), and in this manner, a low-loss reactor 1 is easily constructed.

For example, with regard to the relationship between the cross-sectional area of the first wire 21*w* and the cross-sectional area of the second wire 22*w*, the cross-sectional area of the first wire 21*w* and the cross-sectional area of the second wire 22*w* may be equal to each other. This means that the cross-sectional area of the strands 221 and 222 of the second wire 22*w* is smaller than the cross-sectional area of the strand 211 of the first wire 21*w*. In this case, the DC resistance of the second winding portion 22 is equal to the DC resistance of the first winding portion 21, but the AC resistance of the second winding portion 22 is likely to be lower than the AC resistance of the first winding portion 21. The reason for this is that since the cross-sectional area of the strands 221 and 222 of the second wire 22*w* is smaller than the cross-sectional area of the strand 211 of the first wire 21*w*, an increase in the AC resistance caused by the skin effect can be suppressed. Moreover, the cross-sectional area of the strand 211 of the first wire 21*w* and the cross-sectional area of the strands 221 and 222 of the second wire 22*w* may be equal to each other. This means that the cross-sectional area of the second wire 22*w* is larger than the cross-sectional area of the first wire 21*w*. In this case, the AC resistance of the second winding portion 22 is equal to the AC resistance of the first winding portion 21, but the DC resistance of the second winding portion 22 is likely to be lower than the DC resistance of the first winding portion 21. In particular, it is preferable that the relationship in which the cross-sectional area of the second wire 22*w* is larger than the cross-sectional area of the first wire 21*w* and the relationship in which the cross-sectional area of the strands 221 and 222 of the second wire 22*w* is smaller than the cross-sectional area of the strand 211 of the first wire 21*w* are both satisfied. In that case, the DC resistance and the AC resistance of the second winding portion 22 are likely to be lower than the DC resistance and the AC resistance, respectively, of the first winding portion 21. A reduction in the AC resistance of the second winding portion 22 is especially effective when the coil is used at a high frequency. The relationship between the cross-sectional areas of the first wire 21*w* and the second wire 22*w* can be appropriately selected depending on the numbers of turns and axial lengths L1 and L2 of the winding portions 21 and 22.

Size

Figure 2:
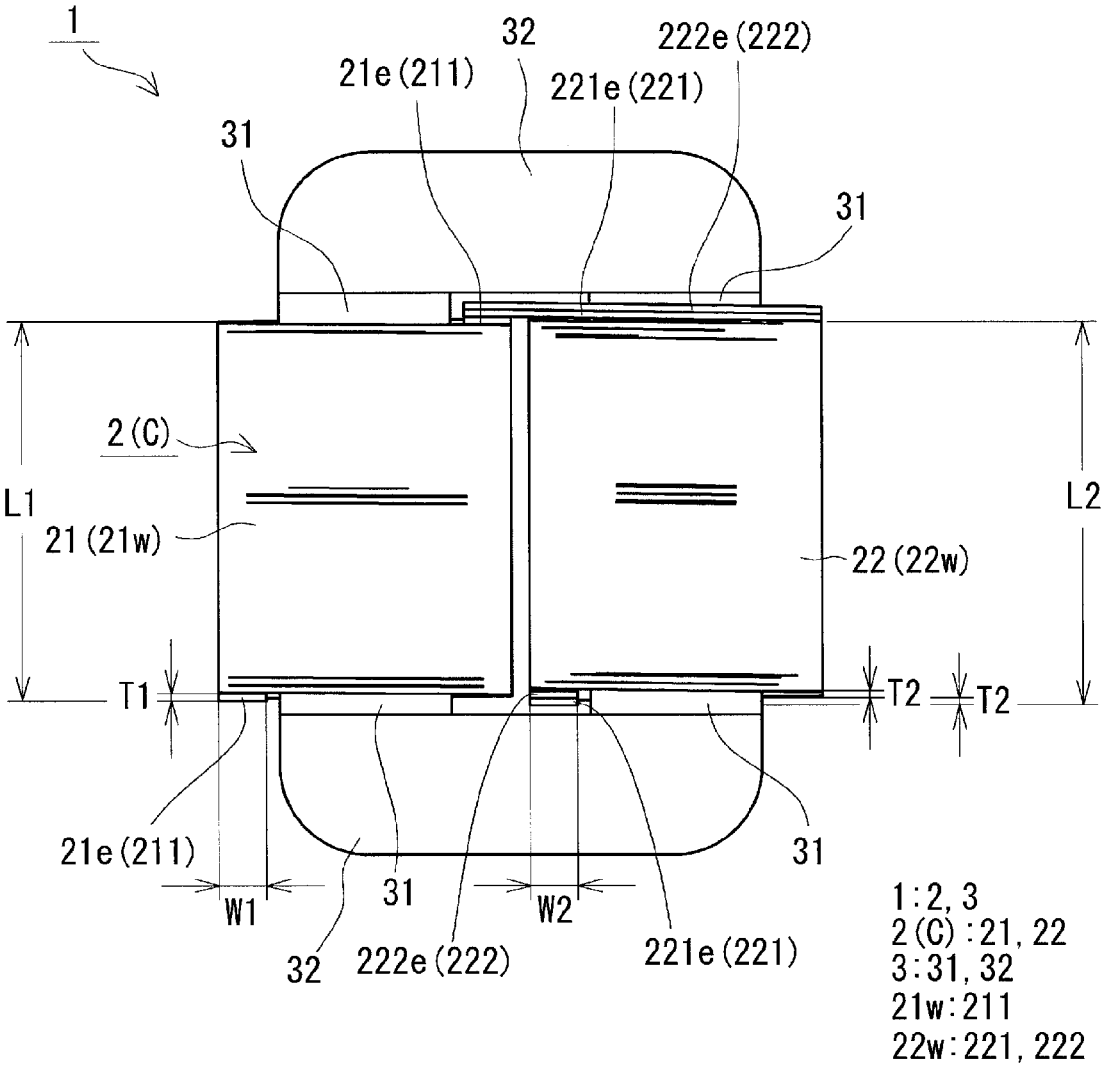
FIG. 2 is a top view schematically showing the reactor according to Embodiment 1.

The sizes of the first wire 21*w* and the second wire 22*w* may be different from each other so as to satisfy a relationship "(width W1 of first wire 21*w*)<(width W2 of second wire 22*w*)", but it is preferable that a relationship "(width W1 of first wire 21*w*)=(width W2 of second wire 22*w*)" is satisfied (FIG. 2). In the case where the first wire 21*w* includes one strand, the width W1 of the first wire 21*w* refers to the width of the single strand 211, and in the case where the first wire 21*w* includes more than one strand, the width W1 of the first wire 21*w* refers to the width of each strand. In the case where the first wire 21*w* includes more than one strand 211, the strands may have different widths, but preferably have the same width. The width W2 of the second wire 22*w* refers to the width of each of the strands 221 and 222. The strands 221 and 222 of the second wire 22*w* may have different widths, but preferably have the same width. The widths W1 and W2 refer to the lengths of the respective wires 21*w* and 22*w* in a direction in which the winding portions 21 and 22 are arranged in parallel. "The width W1 of the first wire 21*w* and the width W2 of the second wire 22*w* being equal to each other" means such an extent that when the reactor 1 is constructed by combining the coil C with the magnetic core 3, no variations in width and height occur between the first winding portion 21 and the second winding portion 22.

It is preferable that the sizes of the first wire 21*w* and the second wire 22*w* satisfy a relationship "(thickness T1 of first wire 21*w*)≥(thickness T2 of second wire 22*w*)". In the case where the first wire 21*w* includes one strand, the thickness T1 of the first wire 21*w* refers to the thickness of the single strand 211, and in the case where the first wire 21*w* includes more than one strand 211, the thickness T1 of the first wire 21*w* refers to the thickness of each strand. In the case where the first wire 21*w* includes more than one strand 211, the strands may have different thicknesses, but preferably have the same thickness. The thickness T2 of the second wire 22*w* refers to the thickness of each of the strands 221 and 222. The strands 221 and 222 of the second wire 22*w* may have different thicknesses, but preferably have the same thickness. The thicknesses T1 and T2 refer to the lengths of the respective wires 21*w* and 22*w* in the axial directions of the respective winding portions 21 and 22. The relationship between the thickness T1 of the first wire 21*w* and the thickness T2 of the second wire 22*w* can be appropriately selected depending on the numbers of turns and the axial lengths L1 and L2 of the winding portions 21 and 22.

Number of Turns

The total number of turns of the two winding portions 21 and 22 can be appropriately selected depending on the desired inductance. The numbers of turns of the respective winding portions 21 and 22 are appropriately selected depending on the required inductance. The number of turns of the first winding portion 21 refers to the number of turns of the first wire 21*w*. That is to say, in the case where the first wire 21*w* includes one strand, the number of turns of the first winding portion 21 refers to the number of turns of the single strand 211, and in the case where the first wire 21*w* includes more than one strand, the number of turns of the first winding portion 21 does not refer to the sum of the numbers of turns of the plurality of strands but refers to the number of turns of one of those strands. In the case where the first wire 21*w* includes more than one strand 211, the plurality of strands 211 are set to have the same number of turns. The number of turns of the second winding portion 22 refers to the number of turns of the second wire 22*w*. That is to say, the number of turns of the second winding portion 22 does not refer to the sum of the numbers of turns of the strands 221 and 222 of the second wire 22*w* but refers to the number of turns (number of turns of the second wire 22*w*) of a single strand 221 (222) included in the second wire 22*w*. For example, if the numbers of turns of the strands 221 and 222 of the second wire 22*w* are "n (n is a positive integer)", the number of turns of the second winding portion 22 is not "2n" but "n". The number of turns of the second winding portion 22 is often smaller than the number of turns of the first winding portion 21, but can be set to be equal to the number of turns of the first winding portion 21 or greater than the number of turns of the first winding portion 21. The difference between the number of turns of the first winding portion 21 and the number of turns of the second winding portion 22 can be appropriately selected depending on the current-flowing condition of the coil C and the difference between the cooling performance for the winding portion 21 and the cooling performance for the winding portion 22 of the cooling member (cooling base) for cooling the coil C.

Length

The lengths (hereinafter referred to simply as axial lengths) L1 and L2 of the respective winding portions 21 and 22 in their axial directions can be appropriately selected depending on the desired inductance (FIG. 2). Preferably, the axial length L1 of the first winding portion 21 and the axial length L2 of the second winding portion 22 are substantially the same. "The axial length L1 of the first winding portion 21 and the axial length L2 of the second winding portion 22 being substantially equal to each other" means that the difference between the axial length L1 of the first winding portion 21 and the axial length L2 of the second winding portion 22 is 10% or less of the axial length L1 of the first winding portion 21. In that case, if the axial lengths L1 and L2 of the respective winding portions 21 and 22 are substantially the same as the lengths in the axial directions of the inner core portions 31 on which the respective winding portions 21 and 22 are disposed, a reactor 1 with little, or substantially no, dead space can be constructed, and therefore the size of the reactor 1 can be reduced. Preferably, the difference between the axial length L1 of the first winding portion 21 and the axial length L2 of the second winding portion 22 is 5% or less.

End Portions

The end portions 21*e*, 221*e*, and 222*e* on one end side (left side on the paper plane of FIG. 1, lower side on the paper plane of FIG. 2) of the winding portions 21 and 22 in their axial directions are extended upward. The insulating coating of a leading end of each of these end portions is removed to expose the conductor, and a terminal member (not shown) is connected to the exposed conductor. The end portions 221*e* and 222*e* on one end side of the second wire 22*w* are electrically connected to each other. An external device (not shown) such as a power supply that supplies power to the coil C is connected to the coil C via the terminal member. On the other hand, end portions 21*e*, 221*e*, and 222*e* on the other end side (right side on the paper plane of FIG. 1, upper side on the paper plane of FIG. 2) of the winding portions 21 and 22 in their axial directions are electrically connected to each other. This electrical connection may be realized by directly connecting the end portion 21*e* to the end portions 221*e* and 222*e* as in the present example, or by connecting these end portions via a connecting member independent of the first winding portion 21 and the second winding portion 22. For example, a short conductor (in particular, wire) that has a similar cross-sectional area to the cross-sectional area of the first wire 21*w* or the cross-sectional area of the second wire 22*w* can be used as the connecting member. The end portions

221*e* and 222*e* on the other end side of the second wire 22*w* are electrically connected to each other, as is the case with those on one end side.

In the case where the end portion 21*e* of the first winding portion 21 is directly connected to the end portions 221*e* and 222*e* of the second winding portion 22, a configuration is conceivable in which, as in the present example, the end portion 221*e*/222*e* side of the second wire 22*w* is bent and extended toward the end portion 21*e* of the first wire 21*w*, and the end portion 21*e* is connected to the end portions 221*e* and 222*e*. With regard to the method for bending the end portion 221*e*/222*e* side of the second wire 22*w*, a method may be adopted in which the end portion 221*e*/222*e* side of the second wire 22*w* is bent edgewise like turn-forming portions as shown in FIG. 1. The second wire 22*w* is easy to bend because the thickness T2 of the strands 221 and 222 thereof is smaller than the thickness T1 of the first wire 21*w* (strand 211).

Instead of bending the end portion 221*e*/222*e* side of the second wire 22*w*, the end portion 21*e* side of the first wire 21*w* may be bent and extended toward the end portion 221*e*/222*e* side of the second wire 22*w*. When bending the end portion 21*e* side of the first wire 21*w*, the bending method may be edgewise bending, or a method may be adopted in which the end portion 21*e* side of the first wire 21*w* is folded back flatwise, and in the folded-back portion, portions of the wire are laid one on top of the other in the thickness direction such that the extending direction of the first wire 21*w* is changed by 90°. Although the thickness T1 of the strand 211 of the first wire 21*w* is greater than the thickness T2 of each of the strands 221 and 222 of the second wire 22*w*, the number of strands 211 here is one, which is smaller than the number of strands 221 and 222 of the second wire 22*w*, and therefore, the first wire 21*w* is easy to fold back. On the other hand, in the case where the end portions are connected via the aforementioned connecting member, it is conceivable to use the same wire material as that of the first wire 21*w* or the second wire 22*w* as the connecting member.

The connection of the end portion 21*e* to the end portions 221*e* and 222*e*, the connection of each of the end portion 21*e* and the end portions 221*e* and 222*e* to the above-described connecting member, as well as the connection between the end portions 221*e* and 222*e* can be performed through welding (e.g., TIG welding), soldering, crimping, or the like.

Others

A wire that has a thermally fusion-bondable layer composed of a thermally fusion-bondable resin can be used as each of the strands 211, 221, and 222 of the wires 21*w* and 22*w*. In this case, after the strands 211, 221, and 222 of the wires 21*w* and 22*w* are appropriately wound, the wound wires are heated at an appropriate timing to melt the thermally fusion-bondable layers, and adjacent turns of the wound wires are joined to each other by the thermally fusion-bondable resins. In the thus obtained coil C, since thermally fusion-bondable resin portions are present between the turns, the turns do not substantially offset from each other, and therefore the coil C is unlikely to deform. Examples of the thermally fusion-bondable resins that compose the thermally fusion-bondable layers include thermosetting resins, such as epoxy resins, silicone resins, and unsaturated polyesters.

Production

To produce a coil C, a first winding portion 21 and a second winding portion 22 are individually prepared, and an end portion 21*e* of the first winding portion 21 is connected to end portions 221*e* and 222*e* of the second winding portion 22. The first winding portion 21 can be prepared by providing a first wire 21*w* including at least one (here, one) strand 211 and helically winding the first wire 21*w*. The second winding portion 22 may be prepared by providing a second wire 22*w* including a plurality of (here, two) strands 221 and 222 and simultaneously winding the plurality of strands 221 and 222, or by combining winding components obtained by separately winding the plurality of strands 221 and 222. The simultaneous winding is performed by simultaneously helically winding the plurality of strands 221 and 222 that are superposed in the winding direction. With respect to combining the separately wound winding components, first, the two strands 221 and 222 are helically wound separately to prepare two winding components. At this time, the pitch of turns of the winding components is adjusted so that the turns of one of the winding components can fit between the turns of the other winding component. Then, the two winding components are fitted to each other so that the turns of one of the winding components are fitted between the turns of the other winding component.

Effects of the Coil

With the above-described coil C, the specific relationship with respect to heat generation characteristics, in which the first winding portion 21 generates more heat and the second winding portion 22 generates less heat, is satisfied. Therefore, the coil C can be suitably used for a reactor 1 that is cooled by a cooling member with unbalanced cooling performance.

Reactor

The above-described coil C can be used as the coil 2 of the reactor 1 shown in FIGS. 1 and 2. As described at the beginning of Embodiment 1, the reactor 1 includes the coil 2 and the magnetic core 3 on which the coil 2 is disposed. The coil 2 is constituted by the above-described coil C.

Coil

The coil 2 includes the first winding portion 21 and the second winding portion 22, which have been described above. The two winding portions 21 and 22 are arranged side-by-side (in parallel) so that their axial directions are parallel to each other. This coil 2 is cooled by a cooling member (not shown). The cooling member may be, in the present example, a cooling base that includes a first cooling portion for cooling the first winding portion 21 and a second cooling portion for cooling the second winding portion 22, the details of which will be described later. The cooling performance of the first cooling portion is higher than the cooling performance of the second cooling portion. That is to say, the two winding portions 21 and 22 are arranged such that the first winding portion 21 is disposed on the first cooling portion side with the higher cooling performance, and the second winding portion 22 is disposed on the second cooling portion side with the lower cooling performance. Therefore, the first winding portion 21 and the second winding portion 22 are evenly cooled, and a difference in temperature between the two winding portions 21 and 22 can be made less likely to be generated.

Magnetic Core

The magnetic core 3 includes a pair of inner core portions 31 that are disposed inside the respective winding portions 21 and 22 and a pair of outer core portions 32 that protrude (are exposed) from the coil 2 without the coil 2 being disposed thereon. The magnetic core 3 is formed into a ring-like shape in which the outer core portions 32 are arranged so as to sandwich the inner core portions 31 that are arranged spaced apart from each other, and end surfaces of the inner core portions 31 are in contact with inner end surfaces of the outer core portions 32. The inner core portions 31 and the outer core portions 32 together form a closed magnetic circuit when the coil 2 is energized. A known magnetic core can be used as this magnetic core 3.

Inner Core Portions

Each of the inner core portions 31 may be composed of a stacked body in which a plurality of column-shaped core pieces and gap portions made of a material having a lower relative permeability than the core pieces are alternately stacked and arranged, or may be composed of a single column-shaped core piece having approximately the same length as the total length of the corresponding winding portion 21 or 22 in the axial direction without including a gap portion. The lengths of the pair of inner core portions 31 in the axial direction of the coil 2 are the same, and are substantially the same as the length of the coil 2 in the axial direction. It is preferable that the inner core portions 31 have shapes that match the inner peripheral shapes of the respective winding portions 21 and 22. Here, the shapes of the inner core portions 31 are rectangular parallelepiped shapes with approximately the same lengths as the total lengths of the respective winding portions 21 and 22 in their axial directions, and the corner portions of the rectangular parallelepiped shapes are rounded so as to conform to inner peripheral surfaces of the winding portions 21 and 22.

Outer Core Portions

The outer core portions 32 are, in the present example, column-shaped bodies each having substantially dome-shaped upper and lower surfaces. The heights of the outer core portions 32 are greater than those of the inner core portions 31, and it is preferable that the upper surfaces of the outer core portions 32 are substantially flush with upper surfaces of the inner core portions 31, and the lower surfaces of the outer core portions 32 are substantially flush with a lower surface of the coil 2. The heights of the outer core portions 32 refer to the lengths thereof in a vertical direction.

Materials

A powder compact that is obtained by compression molding a soft magnetic powder, a composite material (molded and cured product) in which a soft magnetic powder and a resin are contained and the resin is hardened (cured), or the like can be used for the core pieces of the inner core portions 31 and the outer core portions 32.

Particles constituting the soft magnetic powder may be metal particles of an iron-group metal, such as pure iron, or a soft magnetic metal, such as an iron-based alloy (Fe—Si alloy, Fe—Ni alloy, etc.); coated particles in which an insulating coating composed of a phosphate or the like is provided on outer peripheries of metal particles; particles made of a nonmetal material such as ferrite; or the like.

The average particle diameter of the soft magnetic powder may be, for example, between 1 μm and 1,000 μm inclusive, and furthermore, between 10 μm and 500 μm inclusive. The average particle diameter can be obtained by acquiring a cross-sectional image under an SEM (scanning electron microscope) and analyzing the image using a piece of commercially-available image analysis software. At that time, an equivalent circle diameter is used as the particle diameter of a soft magnetic particle. To obtain the equivalent circle diameter, an outline of a particle is identified, and the diameter of a circle that has the same area as the area S of a region enclosed by the outline is determined as the equivalent circle diameter. That is to say, the equivalent circle diameter is expressed as follows: equivalent circle diameter$=2\times\{$area S of the inside of the outline$/\pi\}^{1/2}$.

Examples of the resin in the composite material include thermosetting resins such as epoxy resins, phenolic resins, silicone resins, and urethane resins; thermoplastic resins such as polyphenylene sulfide (PPS) resins, polyamide (PA) resins (e.g., nylon 6, nylon 66, nylon 9T, etc.), liquid crystal polymers (LCPs), polyimide resins, and fluororesins; normal-temperature curing resins; and low-temperature curing resins. In addition, a BMC (bulk molding compound) manufactured by mixing calcium carbonate and glass fibers in unsaturated polyester, millable silicone rubber, millable urethane rubber, and the like can be used.

The amount of the resin contained in the composite material may be between 20 vol % and 70 vol % inclusive. The lower the resin content, that is, the higher the soft magnetic powder content, the more the saturation flux density and the heat dissipation properties can be expected to be improved. Therefore, the upper limit of the resin content can be set to be 50 vol % or less, and furthermore, 45 vol % or less, or 40 vol % or less. If the resin content is high to a certain extent, that is, if the soft magnetic powder content is low to a certain extent, when the raw material (raw material mixture) of the composite material is filled into a mold, the raw material has excellent fluidity and is easy to fill into the mold, and the manufacturability can be expected to be improved. Therefore, the lower limit of the resin content can be set to be 25 vol 6% or more, and furthermore, 30 vol % or more.

The above-described composite material can also contain a filler powder made of a non-magnetic material such as a ceramic, such as alumina or silica, in addition to the soft magnetic powder and the resin. In this case, the heat dissipation properties, for example, can be improved. The amount of the filler powder contained in the composite material may be between 0.2 mass % and 20 mass % inclusive, and furthermore, between 0.3 mass % and 15 mass % inclusive, or between 0.5 mass % and 10 mass % inclusive.

Cooling Member

The cooling member cools the coil 2, and may be, in the present example, a cooling base that includes, as described above, the first cooling portion and the second cooling portion that have different levels of cooling performance. The cooling base serves as an object on which the reactor 1 is installed. Although the first cooling portion and the second cooling portion may be a plurality of members with different cooling performances, the first and second cooling portions may also be constituted by a single continuous cooling plate in which the cooling performance varies depending on the region because a flow path of a coolant is present only partially in the cooling plate or other reasons. The level of the cooling performance of the first cooling portion and the level of the cooling performance of the second cooling portion may differ to the extent that the first winding portion 21 and the second winding portion 22 can be evenly cooled. For example, it is conceivable that the ratio of the cooling performance (W) of the first cooling portion to the cooling performance (W) of the second cooling portion is about 1:2 to 1:20. In addition, the cooling member may also be a fluid coolant (e.g., FET) that is circulated and supplied. When the cooling performance of this fluid coolant is unbalanced, it means, for example, that the amount of fluid coolant supplied to the first winding portion 21 and the amount of fluid coolant supplied to the second winding portion 22 are different. Specific examples include a case in which, if the cooling of the coil 2 is realized by pouring the fluid coolant thereon, the state in which the fluid coolant comes into contact with the winding portion differs between the winding portions 21 and 22 depending on the manner of pouring; a case in which, if the reactor 1 is disposed in a portion through which the fluid coolant circulates, the state in which the fluid coolant comes into contact with the winding portion differs between the winding portions 21 and 22 depending on the difference in the amount of circulating fluid coolant; and other cases.

Uses

The reactor 1 can be suitably used for a constituent component of various converters, such as in-vehicle converters (typically, DC-DC converters) installed in vehicles such as hybrid automobiles, plug-in hybrid automobiles, electric automobiles, and fuel-cell electric automobiles and converters for air conditioners, and power conversion devices.

Effects of the Reactor

With the above-described reactor 1, since the reactor 1 includes the coil 2 having the first winding portion 21 that generates more heat and the second winding portion 22 that generates less heat, it is possible to reduce the loss that occurs in the case where the cooling performance of the cooling member for cooling the coil 2 is unbalanced.

The present disclosure is not limited to the foregoing examples, but rather is defined by the claims, and all changes that come within the meaning and range of equivalency of the claims are intended to be embraced therein.

The invention claimed is:

1. A coil comprising:

a first winding portion that is formed by helically winding a first wire including one strand so as to define a plurality of first turns, the one strand being a plate shaped member having a first surface opposite of a second surface, the first surface and the second surface being planar; and a second winding portion that is formed by helically winding a second wire to define a plurality of second turns, the second wire including a plurality of second strands and being electrically connected to the first winding portion, the plurality of second strands being a plate shaped member having a pair of planar surfaces opposite of each other, wherein at least one of the pair of planar surfaces of at least one of the plurality of second strands is flush against at least one of the first surface and the second surface of the one strand and wherein the second wire has an axis that is parallel to an axial direction of the first winding portion, wherein the first winding portion and the second winding portion are arranged side-by-side, the strands included in the second wire are arranged in parallel in an axial direction of the second winding portion, the number of strands included in the second wire is greater than the one strand included in the first wire, a cross-sectional area of the second wire is equal to or larger than a cross-sectional area of the first wire, and a cross-sectional area of each strand included in the second wire is equal to or smaller than a cross-sectional area of the one strand included in the first wire.

2. The coil according to claim 1, wherein the difference between a length of the first winding portion in the axial direction and a length of the second winding portion in the axial direction is 10% or less of the length of the first winding portion in the axial direction.

3. The coil according to claim 1, wherein conductor wires of the strand included in the first wire and the plurality of second strands included in the second wire are rectangular wires, and the one strand included in the first wire and each of the plurality of second strands included in the second wire have the same width.

4. A reactor comprising:

a coil; and a magnetic core on which the coil is disposed, wherein the coil is the coil according to claim 1.

5. The coil according to claim 2, wherein conductor wires of the strand included in the first wire and the plurality of second strands included in the second wire are rectangular wires, and the one strand included in the first wire and each of the plurality second of strands included in the second wire have the same width.

* * * * *